United States Patent [19]

Suga

[11] Patent Number: 5,019,834

[45] Date of Patent: May 28, 1991

[54] ELECTRICALLY POWERED MECHANISM FOR EXPANDING AND CONTRACTING ANTENNA

[75] Inventor: Mitsuhiro Suga, Warabi, Japan

[73] Assignee: Nippon Antenna Company Limited, Tokyo, Japan

[21] Appl. No.: 377,593

[22] Filed: Jul. 10, 1989

[51] Int. Cl.[5] ..... H01Q 1/10

[52] U.S. Cl. ..... 343/877; 343/903

[58] Field of Search ..... 343/900, 901, 903, 715, 343/877; 242/54 A

[56] References Cited

U.S. PATENT DOCUMENTS

| | | | |
|---|---|---|---|
| 2,896,870 | 7/1959 | Ulrich | 242/54 A |
| 3,195,823 | 7/1965 | Simmons | 242/54 A |
| 4,190,841 | 2/1980 | Harada | 343/903 |
| 4,665,406 | 5/1987 | Takizawa et al. | 343/903 |
| 4,742,360 | 5/1988 | Carolus et al. | 343/903 |

FOREIGN PATENT DOCUMENTS

| | | | |
|---|---|---|---|
| 881965 | 7/1949 | Fed. Rep. of Germany | 343/903 |
| 1081711 | 12/1954 | France | 343/903 |
| 511925 | 1/1955 | Italy | 343/903 |
| 39-27972 | 9/1964 | Japan . | |
| 44-10431 | 4/1969 | Japan . | |
| 5436613 | 7/1977 | Japan | 343/903 |
| 58-18323 | 4/1983 | Japan . | |
| 718339 | 11/1954 | United Kingdom | 343/903 |

*Primary Examiner*—Michael C. Wimer

*Attorney, Agent, or Firm*—Frishauf, Holtz, Goodman & Woodward

[57] ABSTRACT

In an electrically powered mechanism for expanding and contracting antenna in which an operation strip coupled to antenna overcoat members that are telescopically connected to expand or contract, is expanded or contracted by a rotary member driven by a motor, and the operation strip has a width greater than the thickness thereof, and has arcuate surfaces or flat surfaces; the rotary member is rotatably provided in a case body which is provided with an annular guide portion with a guide groove for guiding the operation strip to the side of the drum and to the side of the antenna overcoat members, and a strip-receiving groove is formed along said rotary member into which the operation strip is fitted; and the operation strip is fitted in a curved manner to the strip-receiving groove, and a torque for delivering or pulling the operation strip when the rotary member is roated is so selected as to produce a required holding force depending upon the thickness of the operation strip, the radius of curvature of the strip-receiving groove and the width of the strip-receiving groove.

6 Claims, 4 Drawing Sheets

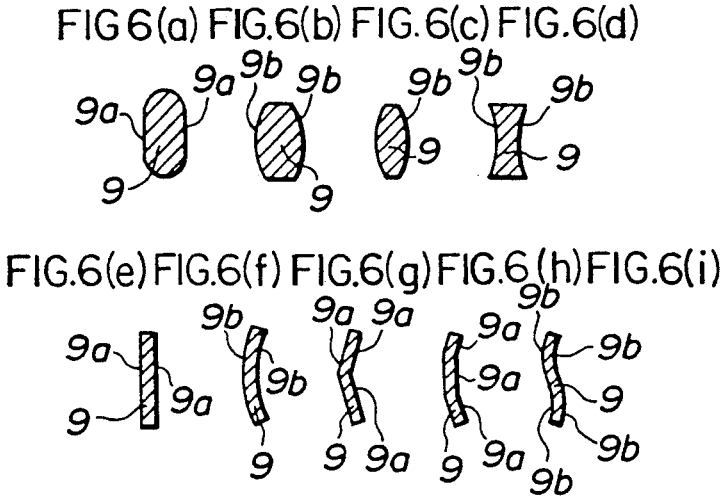
FIG. 7 (PRIOR ART)
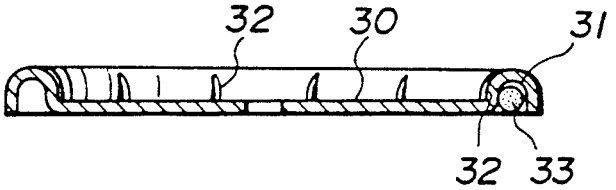
FIG. 8 (PRIOR ART)
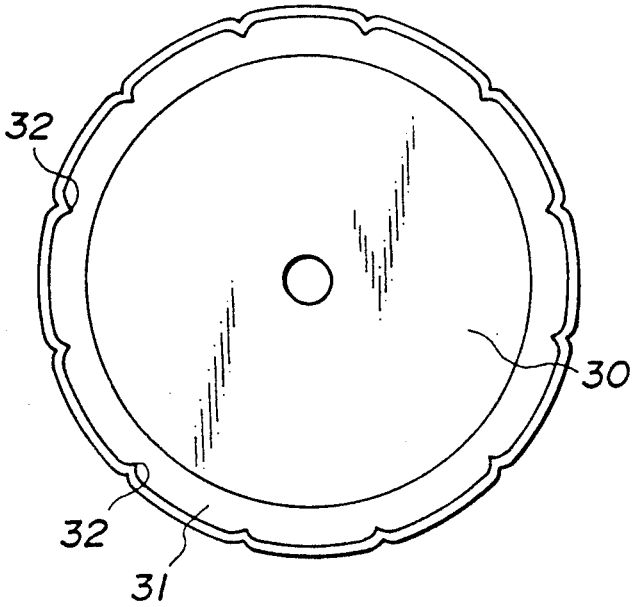

ELECTRICALLY POWERED MECHANISM FOR EXPANDING AND CONTRACTING ANTENNA

BACKGROUND OF THE INVENTION

1. Field of the Invention

The present invention relates to an electrically powered mechanism for expanding and contracting antenna. More specifically, the invention relates to a mechanism for operating an expansion/contraction operation member which efficiently drives a strip such as a wire, which multiplies the drive force, is simple in construction, does not permit the wire to be buckled, and enables the wire to be easily replaced.

2. Prior Art

A variety of systems have heretofore been placed in practical use to pull out or insert a wire connected to an antenna that is mounted on a vehicle such as a motor car and that is expanded or contracted by a rotary member driven by a motor. Such mechanisms for expanding and contracting the antennas can be roughly classified into:

(1) Those of the generally so-called drum type in which a base end of the wire is fastened or is loosely fastened to a drum for winding the wire, and the wire is sent or is taken up by rotating the drum, such that the antenna is expanded or contacted by the wire as disclosed in Japanese Utility Model Publication No. 10431/1969;

(2) Those of the so-called roller type in which a U-shaped or a V-shaped groove is formed along the circumference of a rotary member, a pressing roller is provided to fit a wire to the groove and to bring the wire into intimate contact with the back portion to produce the pressing action relying upon the frictional force, and the pressing force or the drawing force is obtained by the rotation of the roller, or a corrugation is formed on both sides of the groove of the rotary member and a flexible wire is brought into engagement with the rotary member, as disclosed in Japanese Utility Model Publication No. 27972/1964;

(3) Those of the so-called pinion-rack system in which engaging teeth are formed along the periphery of the rotary member, the wire is imparted with a tooth form that meshes with the engaging teeth, and the wire is driven based on the relationship of rack and pinion, as disclosed in, for example, Japanese Utility Model Publication No. 18323/1983; and (4) Those of the so-called tenor system in which the rotary member described in (2) above has an annular groove 31 formed in one surface thereof as shown in FIGS. 7 and 8, pawls 32 are formed maintaining a distance along the circumference of the annular groove 31 to prevent slipping relative to a wire 33 that has a round shape in cross section, and the expansion or contraction operation is carried out relative to the case body by the turn of the rotary member 30, as disclosed in, for example, U.S. Pat. No. 2,896,870.

The above-mentioned conventional devices, however, have disadvantages and defects, and are not necessarily desirable.

That is, in the device of the drum type mentioned in (1) above, buckling phenomenon takes place due to the size of the internal volume of the drum which provides the requisite capacity for accommodating the wire in the drum. That is, when the antenna is stretched and only a small amount of the wire left in the drum thereby creating a sizeable empty space, the wire buckles in the space. When an expanding force of greater than, for example, 5 kg is required, it becomes difficult therefore to obtain the expanding action effectively. In the drum-type device, furthermore, the wire must be properly attached to the drum to carry out expansion operation and contraction operation stably. When it is required to repair or renew the wire, the operation mechanism must be removed from the vehicle and must then be disassembled, thereby creating difficulties from the standpoint of after-sale service. Further, a large drive torque is required to drive the drum.

In the device of the roller type mentioned in (2) above, the wire must be forcibly held by the pressing roller to obtain a strong pressing force or contracting force. Therefore, the wire is subject to be worn out or it deteriorates with the forcibly held point as a center which is the secondary damage. When the wire is made of a hard synthetic resin as is generally used, in particular, the damage spreads in an accelerating manner and durability is not maintained sufficiently. Furthermore, the force for holding the wire creates a large load for the motor that drives the drum; i.e., a motor which produces a large amount of power is required, and the mechanism is subjected to be worn out to a considerable degree. Since a large holding force must be applied as described above, the rotary member and the pressing roller must inevitably be made of a strong material such as a metal which requires countermeasure against rust.

In the device of the pinion-rack type mentioned in (3) above, teeth that are molded on the wire produces distortion which cause variance in the durability; i.e., stable durability is not obtained. With the teeth being formed as described above, furthermore, the strength of the wire becomes inferior to that of the straight wire of the same diameter (without teeth), whereby buckling phenomenon takes place to a considerably degree. Under low-temperature and freezing conditions such as in cold regions, in particular, the frequency of trouble increases inevitably. Moreover, the wire is produced through an increased number of steps that result in an increase in the manufacturing cost.

In the device of the tenor type described in (4) above, the scars of nail are given to the wire by the nails of the rotary member. Further, the scars of nail are given to different positions of the wire due to the rotary motion or a change is temperature. That is, the scars are formed irregularly, and the wire is damaged and is easily broken. In order to prevent a round wire from escaping from the groove of the rotary member, furthermore, it is not allowed to maintain a large gap between the groove of the rotary member and the case body. Therefore, water droplets collect in the gap and freeze. To properly operate the wire, furthermore, the pawls of the rotary member must be composed of a stainless steel or any other metal material.

SUMMARY OF THE INVENTION

The present invention is concerned with an electrically powered mechanism for expanding and contracting antenna in which an operation strip coupled to antenna overcoat members that are telescopically connected to expand or contract, is expanded or contracted by a rotary member driven by a motor, and said operation strip is contained in a drum, the improvement wherein:

said operation strip has a width greater than the thickness thereof, and has arcuate surfaces or flat surfaces;

said rotary member is rotatably provided in a case body which is provided with an annular guide portion with a guide groove for guiding said operation strip to the side of the drum and to the side of the antenna overcoat members, and a strip-receiving groove is formed along said rotary member into which the operation strip is fitted; and said operation strip is fitted in a curved manner to said strip-receiving groove, and a torque for delivering or pulling said operation strip when said rotary member is rotated is so selected as to produce a required holding force depending upon the thickness of the operation strip, the radius of curvature of said strip-receiving groove and the width of said strip-receiving groove.

The operation strip is guided from the drum to the strip-receiving groove of the rotary member via the annular guide portion, and is connected from the strip-receiving groove to an antenna overcoat member that is mounted on the case body via a guide portion on the side of the antenna overcoat member in the annular guide portion.

When the rotary member is rotated under the above-mentioned condition, the operation strip is fitted in a curved manner and receives the delivering torque or the pulling torque owing to the radius of curvature of the strip-receiving groove and the thickness of the operation strip relative to the width thereof, and is delivered toward the antenna overcoat member or is pulled toward the drum. The operation strip which has a width greater than the thickness thereof is specified for its curved or bent direction, i.e., predominantly assumes the curved or bent state having a radius in the direction of thickness thereof.

If the width of the strip-receiving groove is equal to or nearly equal to the thickness of the operation strip, the torque obtained by the operation strip from the rotary member becomes suitable depending upon the fitting degree of the operation strip relative to the receiving width despite the radius of curvature of the operation strip receiving groove is considerably great. Even when the width of the receiving groove is reasonably wide relative to the thickness of the operation strip, the locking force of the rotary member increases relative to the operation strip that is fitted to the receiving groove in a curved manner if the radius of curvature is selected to be smaller than a predetermined value, and the holding force is obtained effectively. That is, even when the thickness of the operation strip is maintained at a constant value, a suitable torque or holding force for delivering or pulling the operation strip can be obtained by suitably selecting either one or both of the width of the receiving groove and the radius of curvature thereof.

BRIEF DESCRIPTION OF THE DRAWINGS

FIGS. 6*a* to 6*i* are diagrams showing some examples of the cross-sectional structure of the operation strip used in the present invention;

FIG. 7 is a section view of a conventional rotary member for feeding the wire of the tenor type; and FIG. 8 is a plan view thereof.

DESCRIPTION OF THE PREFERRED EMBODIMENT

Figure 1:
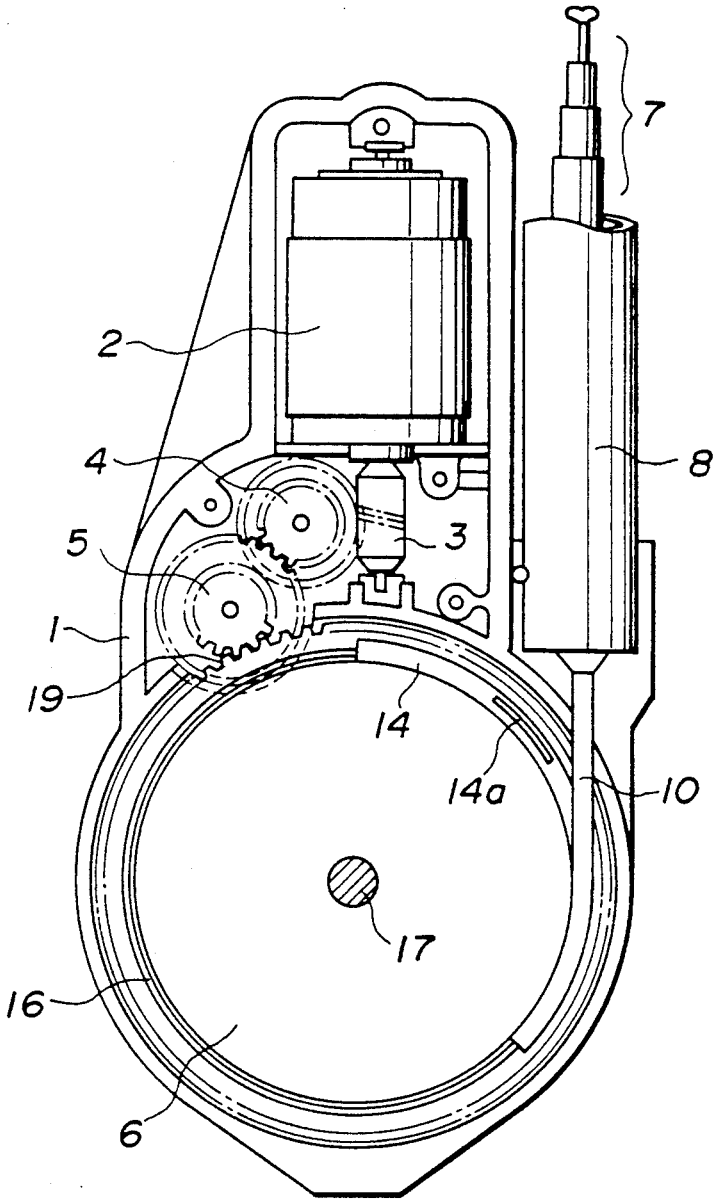
FIG. 1 is a front view showing in a cut-away manner one-half of a two-split case body according to the present invention.
Figure 2:
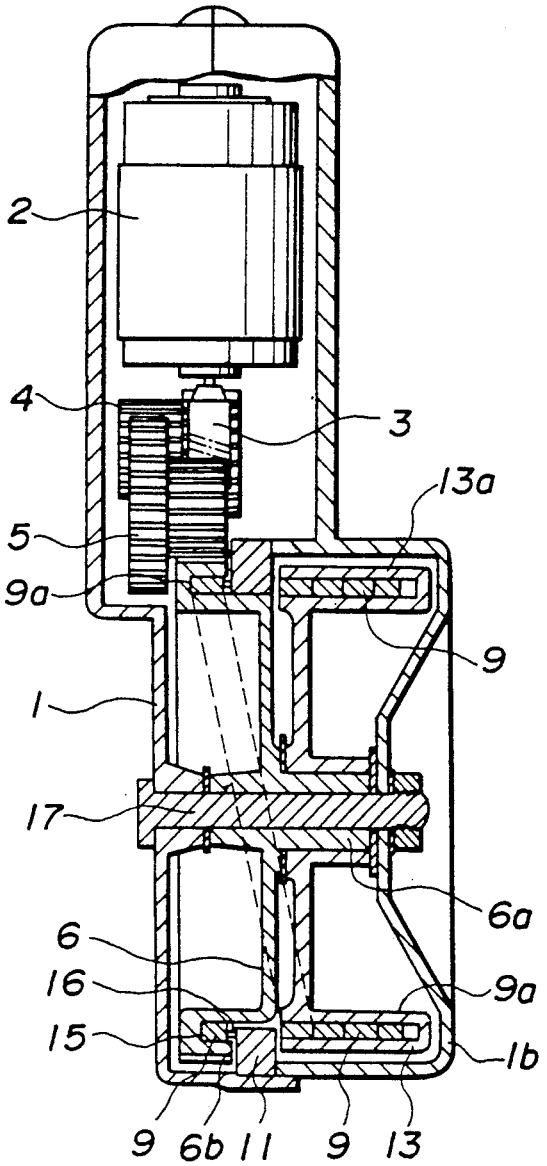
FIG. 2 is a vertical section view thereof.
Figure 3:
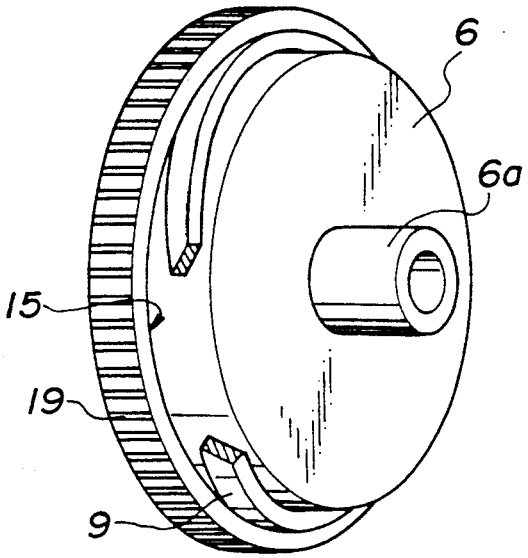
FIG. 3 is a perspective view of a rotary member when it is viewed from the inside.

An embodiment of the present invention will now be described concretely in conjunction with the accompanying drawings. Major portions of the invention are shown in FIGS. 1 and 2, wherein a worm gear 3 of a motor 2 provided on a case body 1 engages, via reduction gears 4 and 5, with a circumferential gear 19 of a drive rotary member 6 to drive it. With reference to FIG. 1, an accommodation cylinder 8 for accommodating an antenna overcoat member is mounted on an upper portion on one side of the case body 1, the antenna overcoat member being comprised of a plurality of elements that are coupled together in a customary manner to expand or contract. A guide hole 10 through which the operation strip 9 passes is formed in the lower portion of the accommodation cylinder 8.

Figure 4:
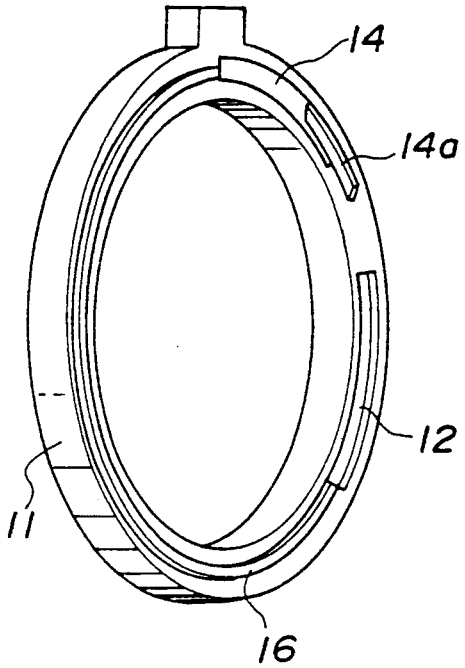
FIG. 4 is a perspective view of an annular guide portion when it is viewed from the side of the junction surface relative to the rotary member.

The outer peripheral portion of an annular guide portion 11 that is shown in FIG. 4 is joined to a circular case portion 1*b* formed on the lower side of the case body 1 as shown in FIG. 2, and the drive rotary member 6 is fitted to the inside of the annular guide portion 11. An engaging stage 6*b* that is formed in a folded manner along the periphery of the drive rotary member 6 is located along the side surface of the annular guide member 11, and space defined between the engaging stage 6*b* and the drive rotary member 6 serves as a groove 15 for receiving a strip such as a wire. The circular case portion 1*b* contains a drum 13 that accommodates the operation strip. The drive rotary member 6 and the drum 13 are rotatably supported by a tightening rod 17 that is provided at a central position of the circular case portion 1*b*, and the operation strip 9 of which the base end is received by the operation strip-receiving groove 13*a* formed along the periphery of the drum 13 is guided along a first guide groove 12 that is formed in the annular guide portion 11 on the side where the antenna stretches, i.e., the first guide groove 12 is formed aslantly so as to be coupled to the guide hole 10 in the case body 1. On an extension in the circumferential direction of the first guide groove 12, there is formed a second accommodation-side guide groove 14 for guiding the strip toward the side of the drum 13 just opposite to the above-mentioned case. Between the first guide groove 12 and the second guide groove 14, there is formed a protuberance 16 that fits to the wire-receiving groove 15 of the drive rotary member 6 over a range of about 180 degrees. The range for forming the protuberance 16, however, may be suitably changed depending upon the conditions such as material of the operation strip 9, cross-sectional shape of the strip 9, width of the receiving groove 15, radius of curvature of the receiving groove 15, and the like. The protuberance 16 works to stably hold the operation strip 9 in the receiving groove 15 with minimal slide resistance. When the rotary member 6 is rotated, the operation strip 9 is fitted in a curved manner to the receiving groove 15 to gain a holding force necessary for the delivery or pulling, and the antenna overcoat member 7 is expanded or contracted.

In the device that is shown, the annular guide portion 11 is formed separately from the case body 1. The annular guide portion 11 is provided with an engaging portion 21 which engages with the case body 1 to establish a unitarily coupled relationship. That is, the annular guide portion 11 is maintained in position relative to the case body 1 irrespective of whether the operation strip 9 that is delivered or pulled slides in the guide grooves 12 and 14. Further, the drum 13 is fitted to the shaft portion 6*a* of the rotary member 6 in which the tightening rod 17 is inserted, and is allowed to rotate about the shaft portion 6*a*. The operation strip 9 is pushed onto the drum 13 along the angle of the second guide groove 14 of the annular guide portion 11, is curved successively and is wound on the drum 13 while it turns. Or, the operation strip 9 that is wound inside the drum 13 is pulled out successively. Furthermore, the annular guide portion 11 is suitably provided with a guide piece 14*a* which is faced to the strip-receiving groove 15 of the rotary member 1 to guide the operation strip 9 into the guide groove 14.

Usually, the above-mentioned antenna overcoat member 7 consists of antenna elements. In the present invention, however, the operation strip 9 may be comprised of a metallic strip or may be reinforced with a carbon fiber. In this case, the operation strip 9 functions as an antenna element. When the operation strip 9 serves as the antenna element, the antenna overcoat member 7 is made up of a plurality of cylinders made of a resin that are coupled together to protect the antenna element.

In FIGS. 1 to 5, the operation strip 9 has a rectangular shape in cross section with flat surfaces 9*a* and 9*a* on both sides thereof. That is, when the strip has flat surfaces on both sides thereof as concretely shown in FIG. 2 or 5, it can be bent relatively easily in a direction at right angles with the flat surfaces even in case the strip consists of a wire made of a material having a considerably large rigidity. Moreover, the flexibility is greatly limited in the direction in parallel with the flat surfaces. Stiffness is also obtained even when the strip is made of a synthetic resin such as a polyacetal provided it has a rectangular shape in cross section with the width being greater than the thickness, e.g., with the width being not more than 3 times of the thickness and, preferably, not more than 2.5 times of the thickness.

According to the present invention, however, the shape in cross section of the operation strip is in no way limited to the rectangular shape only. When the strip is made of a synthetic resin, it may have a circular shape, a drum shape, an oval shape, a concave lens shape or any other shape as shown in FIGS. 6*a* to 6*d*, in addition to the rectangular shape shown in FIGS. 2 and 5. The strip has flat surfaces 9*a* or arcuate surfaces 9*b* formed on both sides thereof. When the operation strip 9 is made of a metal, it may have flat surfaces 9*a*, arcuate surfaces 9*b*, composite flat surfaces 9*a*, 9*a* or composite arcuate surfaces 9*b*, 9*b* as shown in FIGS. 6*e* to 6*i*.

When the antenna overcoat member 7 is to be pushed out, the operation strip 9 having a width greater than a thickness in cross section is not bent in the direction of width but is bent predominantly in the direction of thickness as has been confirmed experimentally. When a considerably strong pressing force is exerted on the strip after the antenna overcoat member is completely expanded, the operation strip 9 is bent like a sine curve in the direction of thickness in the antenna overcoat member 7 along therewith and comes into contact with the inner surface of the antenna overcoat member 7 at each of the inflection points. The operation strip that is bent like a sine curve stores resilient force for expanding the antenna overcoat member 7 in the axial direction. Though the operation member 9 remains curved, the antenna overcoat member 7 effectively maintains the linearity or maintains the stabilized condition. When the antenna overcoat member 7 is expanded or contracted by the operation strip 9 which has a large thickness and is composed of a non-stretching synthetic resin such as the polyacetal that has heretofore been used, small gap is left in the overcoat member 7 for the strip to be bent because of its large thickness. The strip having the cross-sectional shapes as shown in FIGS. 6*e* to 6*i*, however, is allowed to bend. In particular, the strip that is curved or bent at a middle point in the direction of width as shown in FIGS. 6*f* to 6*i* may be flattened at the inflection points. When the strip is released from the curved condition in the lengthwise direction thereof, however, the strip resumes the initial curved or bent shape in cross section and becomes straight in the lengthwise direction. It was mentioned already that the operation strips 9 of FIGS. 6*e* to 6*i* are made of a metal and function as antenna elements. In this case, the thickness may range from about 0.3 to about 1.2 mm. The inflecting points of the operation strip 9 in the lengthwise direction strongly press the inner surface of the antenna overcoat member that has a circular shape in cross section and effectively prevent the antenna overcoat member from sliding sideways. Even in this respect, therefore, the operation strip works to stably extend the antenna overcoat member 7.

Figure 5:
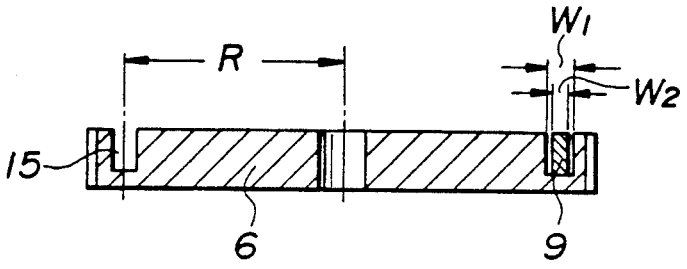
FIG. 5 is a diagram showing a relationship among the width of the groove relative to the rotary member, the thickness of the operation strip and the radius of curvature of the groove in the rotary member.

It is desired that the groove 15 of the drive rotary member 6 and the wire 9 establish a relationship as shown in FIG. 5. That is, the thickness $W_2$ of the operation strip 9 that has flat inner and outer surfaces under the curved condition and the radius R of curvature of the groove 15 of the drive rotary member 6 that receives the operation strip 9, establish an organic relationship relative to the width $W_1$ of the groove 15. If the radius R is gradually decreased while maintaining the thickness $W_2$ of the operation strip constant, the slipping resistance of the operation strip 9 gradually increases in the groove 15 and the locking force is produced; i.e., no slip develops. By suitably utilizing such a relationship, the torque necessary for expanding and contracting the antenna is obtained under the slip-free condition. The relationship may be so selected that slipping develops in the groove 15 when an excess of load is given thereto. In this case, no clutch means is required. The present invention which utilizes the locking function based on the combination of thickness $W_2$ of the operation strip 9, width $W_1$ of the receiving groove and the radius R of curvature, provides increased tolerance for the variance in the size of products and for the change in the drive force that is required, and facilitates the designing. The radius of groove in the drive rotary member and the radius of groove for accommodating the strip in the drum are selected based on the operation strip 9 that has a small natural distortion. Even in this case, the degree of fitness of the wire $W_2$ to the width $W_1$ of groove is suitably selected to easily obtain a desired drive force.

The range of angle at which the operation strip 9 is wound on the wire-receiving groove 15 of the drive rotary member 6 is determined by the thickness of the strip, width of the groove and radius of curvature of the groove 15 as mentioned earlier, or is suitably selected by taking into consideration the material of the operation strip 9 that is used. When the operation strip 9 is composed of a polyacetal resin that is generally used, it has been experimentally confirmed that the operation strip 9 is better wound with about one-half turn as a reference relative to the receiving groove 15 of the rotary member 6 in order to obtain desirable expanding and contracting operations. Therefore, the guide grooves 12 and 14 should be arranged on the annular guide member with the above-mentioned concrete range of winding as a prerequisite.

According to the present invention as described above, the operation strip which has a width greater than the thickness thereof and which further has arcuate surfaces or flat surfaces is delivered or is pulled by the groove that is formed in the rotary member. That is, the antenna is stably expanded or contracted by the locking action in the groove based on the radius of curvature of the groove in the rotary member, the width of the groove and the thickness of the operation strip while effectively eliminating such defects as loss of strength in the cross section of the strip due to the structure of the rack inherent in the conventional pinion-rack system, damage in the strip caused by pawls in the tenor system, and fatigue in the strip caused by the pressing of the roller in the roller system. Namely, there is provided a highly durable mechanism liberating the operation strip from being damaged or broken. Furthermore, the constitution is simple, the constitutional parts can be obtained without requiring any particularly high precision, the torque needs not be adjusted, the operation strip such as wire is not buckled and can be easily renewed. Moreover, the operation strip can be driven efficiently and can be smoothly operated presenting great advantages.

What is claimed is:

1. An electrically powered mechanism for selectively expanding and contracting an antenna, comprising:

antenna overcoat members telescopically connected to expand or contract the antenna;

a drum with an operation strip wound therearound and coupled to the antenna overcoat members;

a rotary member coupled to a motor and having a strip-receiving groove in the form of an arc around its center of rotation;

a case body to which said rotary member is rotatively coupled and having a guide means for guiding said operation strip between the rotary member and the drum, and between the rotary member and the antenna overcoat members so as to maintain some portion of said operation strip in the strip-receiving arcuate groove of the rotary member; and means for applying motive force to the operation strip when said rotary member is rotated based on the thickness of the operation strip, the radius of curvature of said strip-receiving groove, and the width of said strip-receiving groove;

wherein said guide means includes a first guide groove between the drum and the rotary member, a second guide groove between the rotary member and the antenna overcoat members, and an arcuate projection protruding into said strip-receiving groove of the rotary member, and extending at least part way between the first and second guide groove means.

2. An electrically powered mechanism for expanding and contracting antenna according to claim 1, wherein the antenna overcoat members serve as an antenna element, and the operation strip comprises of a wire for expanding and contracting operations.

3. An electrically powered mechanism for expanding and contracting antenna according to claim 1, wherein the antenna overcoat members comprises of cover members that cover the outside of the antenna element, and the operation strip serves as an antenna element.

4. An electrically powered mechanism for expanding and contracting an antenna according to claim 1, wherein the operation strip has a width greater than the thickness thereof.

5. An electrically powered mechanism for expanding and contracting an antenna according to claim 1, wherein the arcuate strip-receiving groove is at the periphery of said rotary member and concentric with its center of rotation.

6. An electrically powered mechanism for expanding and contracting an antenna according to claim 4, wherein the arcuate strip-receiving groove is at the periphery of said rotary member and concentric with its center of rotation.

* * * * *